United States Patent [19]

Stakelbeck et al.

[11] 4,410,330

[45] Oct. 18, 1983

[54] METHOD OF PRODUCING MULTI-COLORED DYEINGS

[75] Inventors: Hans-Peter Stakelbeck, Binzen, Fed. Rep. of Germany; Rudolf Sommerhalder, Basel, Switzerland

[73] Assignee: Sandoz, Ltd., Basel, Switzerland

[21] Appl. No.: 224,105

[22] Filed: Jan. 12, 1981

Related U.S. Application Data

[63] Continuation of Ser. No. 65,695, Aug. 10, 1979, abandoned, which is a continuation-in-part of Ser. No. 933,422, Aug. 14, 1978, abandoned.

[30] Foreign Application Priority Data

Aug. 19, 1977 [CH] Switzerland ..... 10200/77
Aug. 3, 1979 [CH] Switzerland ..... 7157/79

[51] Int. Cl.[3] ..... D06P 5/12; D06P 1/39; D06P 3/87

[52] U.S. Cl. ..... 8/455; 8/485

[58] Field of Search ..... 8/455, 485

[56] References Cited

U.S. PATENT DOCUMENTS

| | | | |
|---|---|---|---|
| 2,217,697 | 10/1940 | Milburn | 8/455 |
| 2,974,395 | 3/1961 | Haskel | 8/455 |
| 3,125,403 | 3/1964 | Senger | 8/455 |
| 3,449,330 | 6/1969 | Guglielmetti et al. | 8/455 |
| 3,468,694 | 9/1969 | Moritz et al. | 8/455 |
| 3,652,198 | 3/1972 | Farber et al. | 8/480 |
| 3,743,477 | 7/1973 | Egli et al. | 8/480 |
| 3,802,905 | 4/1974 | Beyer et al. | 8/480 |
| 4,146,362 | 3/1979 | Nichols | 8/480 |

FOREIGN PATENT DOCUMENTS

| | | | |
|---|---|---|---|
| 1469796 | 12/1968 | Fed. Rep. of Germany | 8/455 |
| 2300618 | 7/1973 | Fed. Rep. of Germany | 8/480 |
| 2623178 | 2/1977 | Fed. Rep. of Germany | 8/480 |
| 1069396 | 7/1954 | France . | |
| 50-3435 | 2/1975 | Japan | 8/478 |
| 51-38591 | 3/1976 | Japan | 8/455 |
| 1169186 | 10/1969 | United Kingdom . | |
| 1176118 | 1/1970 | United Kingdom . | |
| 1264523 | 2/1972 | United Kingdom . | |

*Primary Examiner*—Maria Parrish Tungol
*Attorney, Agent, or Firm*—Gerald D. Sharkin; Richard E. Vila; Thomas C. Doyle

[57] ABSTRACT

A process for dyeing a voluminous flat form anionic dyeable substrate, for example a carpet, comprises applying locally to said substrate one or more dyes, optical brightening agents and/or reserving agents having low migration properties followed by pre-fixation of the same, subsequently dyeing the treated substrate in a short bath with one or more dyestuffs having better migration properties, rolling up the substrate and rotating the rolled-up substrate under conditions to effect fixation of the dyestuffs.

22 Claims, No Drawings

METHOD OF PRODUCING MULTI-COLORED DYEINGS

This is a continuation of application Ser. No. 65,695, filed Aug. 10, 1979, now abandoned, which in turn is a continuation-in-part of application Ser. No. 933,422, filed on Aug. 14, 1978, and now abandoned.

The present invention relates to a process for dyeing a voluminous flat form substrate dyeable with anionic dyes.

It is known to obtain multicoloured effects by locally reserving or dyeing a substrate followed by a further dyeing. In such processes, the local (reserve) dyeings and printings are fixed and then washed and/or rinsed before the subsequent dyeing.

It has now been found that multicoloured effects may be achieved in a more economical way with a shorter fixation time and without any intermediate rinsing or washing step.

Accordingly, the present invention provides a process for dyeing a voluminous flat form anionic dyeable substrate, which process comprises (1) applying locally to the substrate one of the following (a) an anionic dye (b) an anionic optical brightener (c) a reserving agent (d) a basic dye together with a fibre-reactive reserving agent, or (e) a mixture of at least two of (a), (b), (c) and (d)

with the proviso that the component or mixture (a) to (e) has poor migration properties, (2) prefixing at a temperature from 100° C. to 160° C. for 30 to 180 seconds the component applied in step (1), (3) in the absence of a washing or rinsing step, dyeing the treated substrate in a short bath with a dyestuff having better migration properties than the components (a) to (e) above, which dyestuff is suitable for dyeing anionic-dyeable substrates by the cold retention process, (4) rolling up the substrate, and (5) rotating the rolled-up substrate at a temperature of from 15° to 60° C. for 1 to 48 hours, to effect fixation of the dyestuff.

By "voluminous flat form" substrate is to be understood compact textile materials of large continuous surface area, particularly dense woven or knitted fabrics, pile fabrics, velvets, felt and carpets. The substrates dyeable with anionic dyes are those consisting of or comprising polyamide, preferably those consisting of natural polyamide, e.g. wool or silk; synthetic polyamide, e.g. nylon 6, 66, etc.; and blends thereof, including differential synthetic polyamide. The process of the invention is particularly suitable for dyeing synthetic polyamide carpets consisting of nylon or differential polyamide.

It is clear that when an anionic dyestuff is applied alone in step (1) above, it itself must have poor migration properties. Preferred anionic dyes are those which are free from fibre-reactive groups, for example acid dyes and direct dyes. Preferably the anionic dye is an acid dye.

Preferred acid dyes are those having a high molecular weight, i.e. of from 600 to 1050, preferably from 800 to 1050, and containing at least one sulpho group preferably at least two sulpho groups in the molecule. Such dyestuffs are known from the Colour Index; as examples may be given: C.I. Acid Brown 298, Acid Blue 127, Acid Blue 151, Acid Blue 296, Acid Black 52, Acid Black 132, Acid Green 106, Acid Orange 80, Acid Orange 67, Acid Yellow 121, Acid Yellow 151, Acid Yellow 218, Acid Red 216 or Acid Red 263.

When an optical brightener is applied alone, preferred such poor migrating brighteners are those having a molecular weight of about 800–850 and containing at least one sulpho group.

By the term "reserving agent" is to be understood a compound which either forms a covalent bond with the fibre, i.e. a fibre-reactive group-containing-reserving agent, or a compound which envelops the fibre through a non-chemical reaction; these latter types are hereinafter referred to as blocking agents and are known as such as synthetic tannins. As examples of such compounds may be given sulphur-containing phenol or -thiophenol derivatives. Preferred compounds of this type are condensation products of a sulphonated xylene and dihydroxy-diphenylsulphone with formaldehyde. Any of the conventional reserving agents containing a fibre-reactive group may be used; for example, those disclosed in U.K. Pat. No. 1,226,653. Preferably the reserving agent is a blocking agent.

The reserving agents are applied to the substrate in admixture with dyestuffs when bi- or multi-coloured patterns are desired. When a blocking agent/acid dyestuff mixture is applied, any acid dyestuff (classified in the Colour Index under "Acid Dyes") may be used, independently of their migration properties because the so-called blocking agent forms a complex with the dyestuff in such a way as to give a voluminous molecule with poor migration properties. However, the blocking agent is preferably applied in conjunction with acid dyestuffs having poor migration properties. The same applies for brightening agent/blocking agent mixtures.

The local application of dyestuff, optical brightening agent and/or reserving agent may be effected by known methods, in controlled form or at random, for example by the space-dyeing, TAK or polychromatic process. This application can be carried out on pre-wetted or dry material. The preferred techniques include printing or dropping a paste or a liquor of the said dyestuff, brightener and/or reserving agent on the substrate using, e.g. stencils or a TAK machine, in known manner.

In addition to the dyestuff, optical brightening agent and/or reserving agent, the paste or liquor used for the local application may contain conventional additives such as thickeners, dispersing agents, etc. Preferably the paste or liquor contains a thickening agent in order to control the viscosity; the amount of thickener present in the paste or liquor will depend on the patterned effect which is desired. The depth of penetration of the dyestuff and the area of the locally treated portions are dependent upon the viscosity of the said paste or liquor.

When a blocking agent is applied in admixture with an acid dye under acidic conditions, it is advantageous to add an anionic and/or non-ionic dispersing agent to the paste or liquor. Preferably the paste or liquor contains an anionic dispersing agent.

In a preferred embodiment of the local reserving step (1), a blocking agent is applied in admixture with one or more acid dyestuffs in the form of a liquor or paste under acid conditions, the liquor or paste containing an anionic dispersing agent and optionally a thickening agent. Preferred acid liquors or pastes are those containing from 1 to 60 g/l, preferably 5 to 20 g/l, blocking agent and from 1 to 30 g/l, preferably 2 to 10 g/l, dispersing agent, especially an anionic one.

Step (2) is a short heat treatment of the substrate during which the dyestuffs or agents applied in step (1) are at least partially fixed to the extent that, although they may not be wash-fast, their tendency to migrate is substantially inhibited and they will not be displaced during the subsequent ground dyeing. Pre-fixation of the dyestuffs, optical brightening agents and/or reserving agents is preferably effected from 50 to 120 seconds, more preferably from 60 to 90 seconds. It can be achieved by known methods depending on the dyestuff or agent used, e.g. with saturated steam at a temperature of from 100° to 105° C., or with hot air at a temperature of about 160° C. Preferably, the dyestuffs and optical brightening agents are selected so that they are completely fixed under the pre-fixation conditions.

From the molecular weight and number of sulpho groups it is possible to predict the approximate migration properties of the dyestuffs. In cases where it is thought that the migration properties are similar, test methods are known for assessing the degree of migration. The component (a) applied in step (1) and the dye employed in step (3) may have very similar migration properties. However, if this is the case, it is advantageous to employ a smaller amount of (a) than would be normally used in local colouring, e.g. $\frac{1}{3}$ of the normal amount. In this manner light shades are obtained.

The subsequent steps (3), (4) and (5) correspond to the ground dyeing in a short bath of a voluminous flat form substrate according to the cold retention process. Dyestuffs which may be used for the compound dyeing may be any dyestuff suitable for dyeing anionic dyeable substrates, particularly polyamide substrates, by the cold retention process and which have better migration properties than those applied in step (1). Preferred dyestuffs for use in step (3) are acid dyes, particularly those having relatively low molecular weight, i.e. from 400 to 600, and bearing preferably one sulpho group in the molecule. Such dyes are known from the Colour Index; as examples of such dyes may be given: C.I. Acid Red 57, Acid Blue 72, Acid Yellow 196 and Acid Orange 156. In some cases, the dyestuffs with better migration properties as indicated above can bear a second sulpho group in the molecule, i.e. metallic complex dyestuffs.

The ground dyeing of the treated substrate is effected according to known methods, particularly as disclosed in U.K. Pat. Nos. 1,371,781 and 1,470,981. The liquor to goods ratio is below 10:1, preferably in the range of 1:1 to 5:1, more preferably in the range of 2:1 to 3:1. The dyes can be applied from a liquor containing a surface active agent which is either capable of foam or microfoam formation, or which provides a little or no foam. In addition to the dyestuffs and surface active agent, the dye liquor may contain other conventional additives, such as dyeing accelerators, carriers, retarding or levelling agents, dispersing agents, etc.

After application of the dyestuffs, the substrate is rolled up, preferably in a plastic sheet to avoid losses, and then subjected to constant rotation, preferably for a period of 1 to 24 hours, particularly at a temperature of from 20° to 40° C. The speed of rotation is preferably kept low, e.g. of the order of from 1 to 20 r.p.m., particularly from 1 to 6 r.p.m. The constant rotation causes an even distribution of the dyeing medium throughout the substrate. As time elapses during the rotation, fixation takes place as usual in the cold retention process. After fixation has been achieved, the substrate may be dried in conventional manner or, if desired, freed from any remaining liquor or liquor additive by rinsing or hydroextraction.

Because of the poorer migration properties of the dyestuff, or optical brightening or reserving agent used in the local application, ground dyeing is possible without mutual bleeding, despite the subsequent rotation step of 1 to 48 hours; this is due to the pre-fixed dyestuff or optical brightening or reserving agent being checked in its migration properties. Dyeings obtained according to the process of the invention show good light, wet and rubbing fastness properties. Good results are particularly obtained when the process is effected on basic white or pre-dyed polyamide tufted carpets.

The dyeing process of the invention displays all the advantages of dyeing a voluminous flat form substrate with short baths through the cold retention process. Multicoloured patterns on a base dyeing are obtained in an economical way; no intermediary rinsing or washing step is necessary between the pre-fixation (2) and the subsequent ground dyeing (3). Furthermore the pre-fixation treatment is shorter than in the hitherto known processes. This is particularly advantageous for the dyeing of voluminous substrates, e.g. carpets, enabling thereby important energy and water savings.

The following Examples further serve to illustrate the invention. In the Examples all parts are by weight and all temperatures are in degrees Centigrade unless otherwise stated.

EXAMPLE 1

(1) Local Colouring

A loop pile polyamide carpet with polypropylene backing is treated according to the TAK method with drops of a liquor containing, per 1000 parts:

- 3 parts C.I. Acid Brown 298
- 8 parts of a commercial thickening agent based on etherified locust bean flour
- 4 parts of a commercial non-ionic wetting agent based on an addition product of ethylene oxide to a higher alkylphenol
- 2 parts of a commercial anionic dispersing agent based on sodium higher alkylsulphonate, and
- 8 parts of 80% acetic acid.

The carpet can also be printed by stencils, employing the same dyeing mixture. The thus treated material is then treated for 80 seconds with saturated steam.

(2) Ground dyeing

A dye liquor containing, per 1000 parts:

- 0.4 part C.I. Acid Orange 156
- 0.18 part C.I. Acid Red 57
- 0.15 part C.I. Acid Blue 72
- 4 parts of a commercial non-ionic wetting agent based on an additional product of ethylene oxide to a higher alkylphenol
- 3 parts of a mixture of the following components
  - 8 parts of benzyl alcohol
  - 9 parts of monophenylglycol ether, and
  - 3 parts of octylphenylpentaglycol ether, and
- 8 parts of 80% acetic acid is poured on the locally dyed carpet in a liquor to goods ratio of 2.5:1. Subsequently, the impregnated carpet is rolled up on a roll, packed in a polyethylene sheet so as to be air-tight, and rotated at a speed of 3 r.p.m. for 16 hours at room temperature. The carpet is then rinsed and, after water extraction, dried.

An evenly dyed, beige patterned carpet is obtained.

EXAMPLE 2

(1) Local reserving

A cut loop pile polyamide carpet with polypropylene backing is printed with a paste containing per 1000 parts 10 parts of a commercial reserving agent based on a sulphonated xylene and dihydroxydiphenylsulphone,
2 parts of a commercially available dispersing agent, based on sulphonated naphthalene,
15 parts of a commercial thickening agent as in Example 1,
2 parts of a commercial wetting agent based on a anionic modified sodium alkylsulphate, and
15 parts of acetic acid 60%.

Fixation is effected as indicated in Example 1.

(2) Ground dyeing

A dye liquor containing, per 1000 parts:

2.8 parts C.I. Acid Orange 156
2.1 parts C.I. Blue 72
2 parts of the wetting agent of Example 1
1 part of a non-ionic addition product of ethylene oxide on iso-octylphenol
5 parts of acetic acid 60% is poured on the locally reserved carpet in a liquor to goods ratio of 2.2:1. Subsequently, the impregnated carpet is rolled up on a roll, packed in a polyethylene sheet so as to be air-tight, and rotated at a speed of 3 r.p.m. for 20 hours at a temperature from 15° to 30° C. The carpet is then rinsed and, after water extraction, dried.

An evenly, olive-green dyed carpet presenting a white reserve pattern is obtained.

EXAMPLE 3

A differential loop pile polyamide carpet with variable lengths of pile is treated following the procedure of example 1, employing a liquor containing, per 1000 parts:

(1) Local colouring (a)
3 parts C.I. Acid Yellow 121
1.5 parts C.I. Acid Green 106 or (b)
2 parts C.I. Acid Green 106 and 8 parts of a commercial thickening agent as in example 1
3 parts of a commercial non-ionic wetting agent as in example 1
3 parts of a commercial anionic dispersing agent as in example 1, and
8 parts of 80% acetic acid.

(2) Ground dyeing 1.4 parts C.I. Acid Orange 156
1 part C.I. Acid Blue 72
4 parts of a commercial non-ionic dispersing agent as in example 1
3 parts of a mixture of benzyl alcohol, monophenylglycol ether and octylphenylpentaglycol ether as in example 1, and
12 parts of 80% acetic acid.

A strongly-patterned, even olive-green carpet is obtained.

EXAMPLE 4

(1) Local colouring

A loop pile polyamide carpet is printed with a liquor containing, per 1000 parts:

20 parts of the reserving agent of Example 2,
4 parts of the dispersing agent of Example 2,
3 parts of C.I. Acid Red 299
15 parts of the thickening agent of Example 1,
2 parts of the wetting agent of Example 2, (used for the local reserving) and
15 parts of acetic acid 60%

(2) Ground dyeing

The resulting carpet is subsequently dyed with the same liquor as used in Example 2 for the ground dyeing, employing the procedure of Example 2.

There is obtained an even olive-green dyed carpet with ruby red patterns.

EXAMPLE 5

(1) Local colouring

A polyamide carpet (Polyamide DU PONT 833) is treated according to the TAK method by a liquor containing, per 1000 parts:

0.4 part C.I. Acid Yellow 151
0.36 part C.I. Acid Red 216
1 part C.I. Acid Brown 298
5 parts of a commercial thickener as in Example 1
3 parts of a commercial wetting agent based on a monophenylpolyglycol ether, and
15 parts of 60% acetic acid.

Fixation of this local colouring is effected as indicated in Example 1.

(2) Ground dyeing

The resulting carpet is subsequently dyed with a liquor containing, per 1000 parts:

0.48 part C.I. Acid Yellow 196
0.1 part C.I. Acid Orange 156
0.13 part C.I. Acid Blue 72
1 part of a commercial non-ionic wetting agent as in Example 1, and
2 parts of a commercial wetting agent based on a monophenylpolyglycol ether.

Fixation is effected for 16 hours at a temperature of 20°, as indicated in Example 1.

An evenly dyed, brown patterned carpet is obtained.

EXAMPLE 6

(1) Local colouring

Two liquors containing, per 1000 parts:

(a) 40 parts of a commercial reserving agent based on a sulphonated phenyltriazine with fibre-reactive groups such as chlorine atoms, or
(b) 8 parts of the same reserving agent and 8 parts of a commercial thickening agent based on etherified locust bean flour
6 parts of a commercial non ionic wetting agent as in Example 1
4 parts of a commercial anionic dispersing agent as in Example 1
60 parts of urea, and 10 parts of phosphate puffer are applied in drops as specified in Example 1 on a cut loop polyamide carpet with polypropylene backing. Fixation is effected as indicated in Example 1.

(2) Ground dyeing

The resulting carpet is subsequently dyed with a liquor containing, per 1000 parts:

1.8 parts C.I. Acid Orange 156
0.4 part C.I. Acid Red 57
0.1 part C.I. Acid Blue 72
4 parts of a commercial non-ionic wetting agent as in Example 1
3 parts of a mixture of benzyl alcohol, mono-phenylglycol ether and octylphenylpentaglycol ether as in Example 1, and
12 parts of 80% acetic acid.

Subsequent treatment is effected as indicated in Example 1.

An evenly dyed, orange carpet presenting full or semi-reserve is obtained.

EXAMPLE 7

(1) Local colouring

A polyamide carpet (Polyamide DU PONT 833) is treated according to the TAK method by a liquor containing, per 1000 parts:

5 parts of a commercial thickening agent based on etherified locust bean flour
3 parts of a commercial wetting agent based on a monophenylpolyglycol ether
30 parts of a commercial reserving agent based on an anionic aromatic sulfonate, and
30 parts of 60% acetic acid.

The thus treated material is then steamed for 60 seconds at 100°.

(2) Ground dyeing

The resulting carpet is subsequently dyed with a liquor containing, per 1000 parts:

2.4 parts C.I. Acid Orange 156
1.2 parts C.I. Acid Red 57
2.24 parts C.I. Acid Blue 72
2 parts of a commercial non-ionic wetting agent as in Example 1
3 parts of a commercial mixture as in Example 1
2 parts of a commercial wetting agent based on a mono phenylpolyglycol ether, and
12 parts of 60% acetic acid.

Fixation is effected for 24 hours at a temperature of 20°, as described in Example 1.

A dark brown carpet with light brown patterns is obtained.

EXAMPLE 8

(1) Local colouring

A polyamide carpet (Polyamide DU PONT 833) is treated according to the TAK method by a liquor containing, per 1000 parts:

5 parts of a commercial thickening agent as in Example 1
3 parts of a commercial wetting agent based on a monophenylpolyglycol ether
20 parts of a commercial non-ionic dispersing agent based on a mixture of butyldiglycol, cyclohexanol, ethyleneglycol monoethyl ether and ethylene oxide addition product
5 parts of trisodium phosphate
60 parts of a commercial reserving agent as in Example 6
0.3 part C.I. Basic Orange 58
0.16 part C.I. Basic Red 23
2.6 parts C.I. Basic Blue 120

Fixation is effected as specified in Example 7.

(2) Ground dyeing

The resulting carpet is subsequently dyed with a liquor (pH=5) containing, per 1000 parts:

0.23 part C.I. Acid Yellow 196
0.004 part C.I. Acid Red 57
0.018 part C.I. Acid Blue 72
1 part of a commercial non-ionic wetting agent as in Example 1
2 parts of a commercial wetting agent based on a monophenylpolyglycol ether, and
2 parts of a dispersing agent based on a sodium aromatic sulphonic acid.

Fixation is effected for 16 hours at a temperature of 20° as described in Example 1.

A yellowish beige carpet with blue patterns is obtained.

What we claim is:

1. A process for dyeing a voluminous flat form anionic dyeable substrate which comprises the steps of (1) applying locally to the substrate a component having poor migration properties and selected from the group consisting of
(a) an acid dyestuff,
(b) an anionic optical brightener,
(c) a fibre-reactive group-containing reserving agent or a synthetic tannin blocking agent and
(d) a mixture of at least two of (a), (b) and (c), with the proviso that, except when applied in admixture with a synthetic tannin, the acid dyestuff must have a molecular weight of 600 to 1050 and contain at least two sulpho groups and the anionic optical brightener must have a molecular weight of about 800 to 850 and contain at least one sulpho group, (2) prefixing at a temperature from 100° C. to 160° C. for 30 to 180 seconds the component applied in step (1),
(3) in the absence of a washing or rinsing step, ground dyeing the treated substrate in a short bath at a liquor-to-goods ratio below 10:1 with a dyestuff having better migration properties than the component applied in step (1), which dyestuff is suitable for dyeing anionic-dyeable substrates by the cold retention process,
(4) rolling up the substrate, and
(5) rotating the rolled-up substrate at a temperature of from 15° to 60° C. for 1 to 48 hours, to effect fixation of the dyestuff.

2. A process according to claim 1, in which when component (a) or (b) is applied in conjunction with component (c), then component (c) is a blocking agent.

3. A process according to claim 1, in which a blocking agent and one or more acid dyes are locally applied in admixture in the form of an acid liquor or paste containing an anionic and or non-ionic or both types of dispersing agent.

4. A process according to claim 1 in which step (1) is effected by dropping or printing.

5. A process according to claim 1, in which the prefixing step is carried out for a period of from 50 to 120 seconds.

6. A process according to claim 1, in which the prefixing step is effected with saturated steam at a temperature of from 100° to 105° C.

7. A process according to claim 1, in which the dyestuff of step (3) is an acid dye having a molecular weight from 400 to 600 and bearing a single sulpho group in the molecule.

8. A process according to claim 1, in which the liquor to goods ratio in the dyeing step (3) is from 1:1 to 5:1.

9. A process according to claim 1, in which fixation is carried out by rotation of the rolled-up substrate for a period of from 12 to 24 hours at a temperature from 20° to 40° C.

10. A process according to claim 5, in which the liquor or paste contains an anionic dispersing agent.

11. A process according to claim 1, in which an acid dye having a molecular weight of 800 to 1050 is used in step (1).

12. A process according to claim 1, in which the substrate is a carpet consisting of natural or synthetic polyamide or a mixture thereof.

13. A process according to claim 1 wherein the blocking agent is a condensation product of a sulphonated xylene and dihydroxy-diphenylsulphone with formaldehyde.

14. A process according to claim 1 wherein, in step (5), the substrate is rotated at a speed of 1 to 20 r.p.m.

15. A process according to claim 1 wherein the dyestuff employed in step (3) is an acid dyestuff.

16. A process according to claim 1 wherein the substrate is polyamide.

17. A process according to claim 16 wherein a synthetic tannin blocking agent or a mixture of a synthetic tannin blocking agent and an acid dye is applied in step (1).

18. A process according to claim 17 wherein the acid dye has a molecular weight of 600 to 1050 and contains at least two sulpho groups.

19. A process according to claim 18 wherein, in step (3), the dyestuff applied is an acid dye having a molecular weight from 400 to 600 and bearing a single sulpho group, and the liquor to goods ratio is from 1:1 to 5:1.

20. A process according to claim 18 wherein, in step (1), there is applied to the substrate a mixture of a synthetic tannin blocking agent and an acid dye in the form of an acid liquor or paste containing 1 to 60 g/l of blocking agent and 1 to 30 g/l of an anionic or non-ionic dispersing agent.

21. A process according to claim 1 wherein, component (c) is a synthetic tannin blocking agent.

22. A process according to claim 1, consisting essentially of steps (1) to (5).

* * * * *